US011188017B2

(12) United States Patent
Sato et al.

(10) Patent No.: US 11,188,017 B2
(45) Date of Patent: Nov. 30, 2021

(54) ADJUSTING MECHANISM OF IMAGE FORMING APPARATUS

(71) Applicant: FUJIFILM Business Innovation Corp., Tokyo (JP)

(72) Inventors: Koichi Sato, Kanagawa (JP); Kiyotoshi Kaneyama, Kanagawa (JP); Hibiki Sasaki, Kanagawa (JP); Kaoru Matsushita, Kanagawa (JP); Kentaro Iwamoto, Kanagawa (JP); Toshihiko Kamiyama, Kanagawa (JP); Takaya Yokoyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/931,415

(22) Filed: Jul. 16, 2020

(65) Prior Publication Data

US 2021/0302892 A1 Sep. 30, 2021

(30) Foreign Application Priority Data

Mar. 27, 2020 (JP) ..... JP2020-058859

(51) Int. Cl.

| | |
|---|---|
| ***G03G 15/00*** | (2006.01) |
| ***G03G 15/08*** | (2006.01) |
| ***G03G 15/16*** | (2006.01) |

(52) U.S. Cl.
CPC ..... *G03G 15/6558* (2013.01); *G03G 15/0806* (2013.01); *G03G 15/1605* (2013.01)

(58) Field of Classification Search
CPC ..... G03G 15/6558
See application file for complete search history.

(56) References Cited

U.S. PATENT DOCUMENTS

| | | | | |
|---|---|---|---|---|
| 9,304,472 | B2 | 4/2016 | Ishikawa | |
| 2018/0088495 | A1* | 3/2018 | Watanabe | G03G 15/161 |

FOREIGN PATENT DOCUMENTS

| | | |
|---|---|---|
| JP | 2014134718 | 7/2014 |
| JP | 2017-068186 | 4/2017 |

* cited by examiner

*Primary Examiner* — Victor Verbitsky
(74) *Attorney, Agent, or Firm* — JCIPRNET

(57) ABSTRACT

An image forming apparatus includes a first unit, a second unit, a first adjusting member, and a second adjusting member. The first unit includes an endless first belt member and a first rotating member that rotates while supporting the first belt member. The second unit includes a rotatable second rotating member that opposes the first rotating member with the first belt member interposed therebetween. The first adjusting member is disposed on either one of the first unit and the second unit to adjust a load between the first rotating member and the second rotating member. The second adjusting member is disposed on the other one of the first unit and the second unit to adjust parallelism between the first rotating member and the second rotating member.

19 Claims, 5 Drawing Sheets

ADJUSTING MECHANISM OF IMAGE FORMING APPARATUS

CROSS-REFERENCE TO RELATED APPLICATIONS

This application is based on and claims priority under 35 USC 119 from Japanese Patent Application No. 2020-058859 filed Mar. 27, 2020.

BACKGROUND

(i) Technical Field

The present disclosure relates to an image forming apparatus.

(ii) Related Art

A technology for image forming apparatuses, such as a copying machine, a printer, or a FAX machine, is described in Japanese Unexamined Patent Application Publication No. 2017-68186 ([0040] to [0059] and FIGS. 3 to 6) as an technology of enabling movement to adjust the positions between an endless member such as an intermediate transfer belt and a member opposing the endless member.

Japanese Unexamined Patent Application Publication No. 2017-68186 describes a structure including a moving mechanism (100) disposed near a back-up roller (165), which supports an intermediate transfer belt (151), to adjust the positions between the back-up roller (165) and a second transfer roller (154), which supports a second transfer belt (153). The moving mechanism (100) according to Japanese Unexamined Patent Application Publication No. 2017-68186 has a function of adjusting the position of the back-up roller (165) in the horizontal direction.

SUMMARY

Aspects of non-limiting embodiments of the present disclosure relate to more accurate adjustments of parallelism and load than in the case where a first adjusting member that adjusts the load between a first rotating member, which supports an endless belt member, and a second rotating member opposing the first rotating member, and an adjusting member that adjusts parallelism between the first rotating member and the second rotating member are located close to the first rotating member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus that includes a first unit, a second unit, a first adjusting member, and a second adjusting member. The first unit includes an endless first belt member and a first rotating member that rotates while supporting the first belt member. The second unit includes a rotatable second rotating member that opposes the first rotating member with the first belt member interposed therebetween. The first adjusting member is disposed on either one of the first unit and the second unit to adjust a load between the first rotating member and the second rotating member. The second adjusting member is disposed on the other one of the first unit and the second unit to adjust parallelism between the first rotating member and the second rotating member.

BRIEF DESCRIPTION OF THE DRAWINGS

Exemplary embodiments of the present disclosure will be described in detail based on the following figures, wherein.

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are omitted as appropriate for ease of understanding.

Example 1

Figure 1:
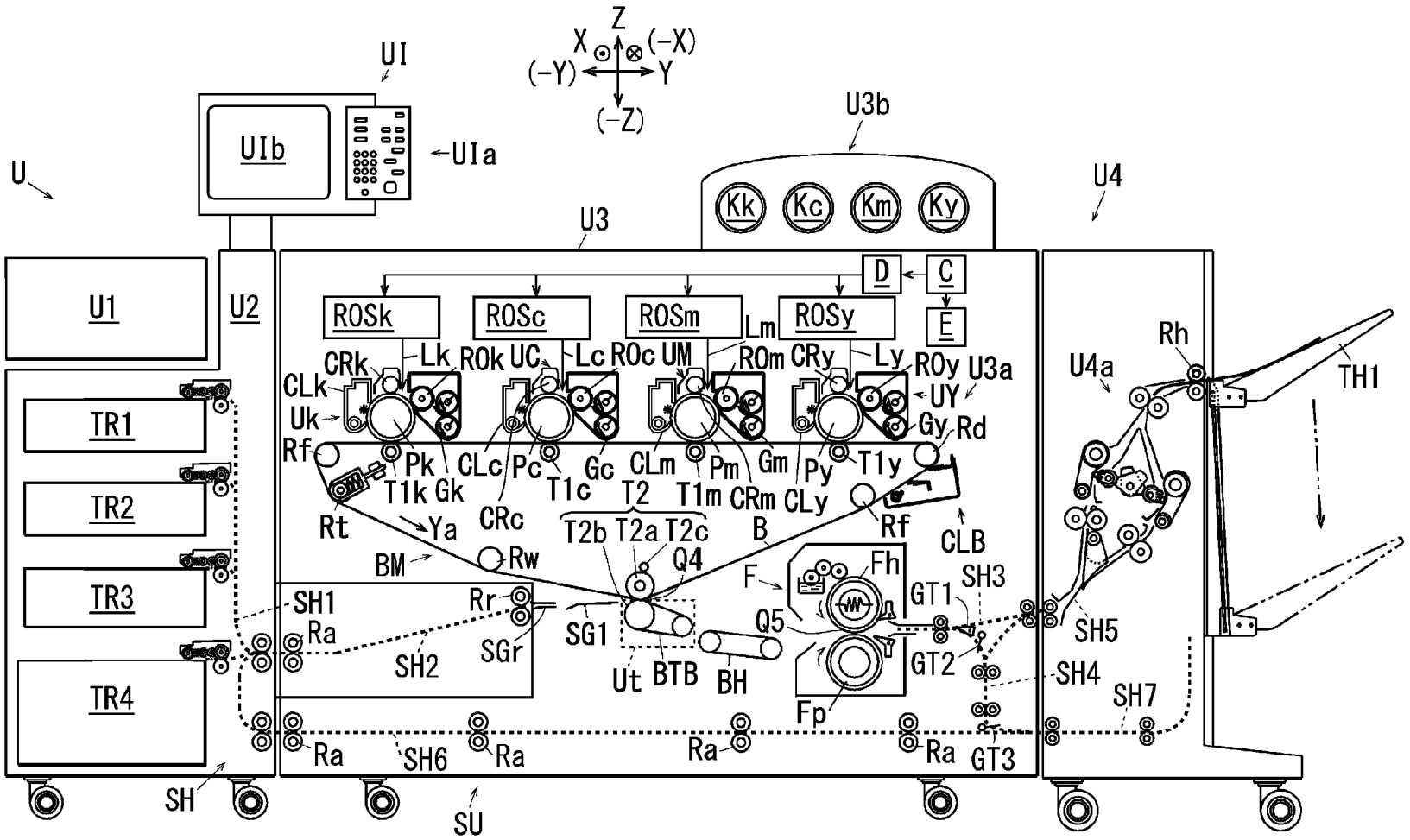
FIG. 1 illustrates the entirety of an image forming apparatus according to an example 1.

FIG. 1 illustrates the entirety of an image forming apparatus according to an example 1.

Figure 2:
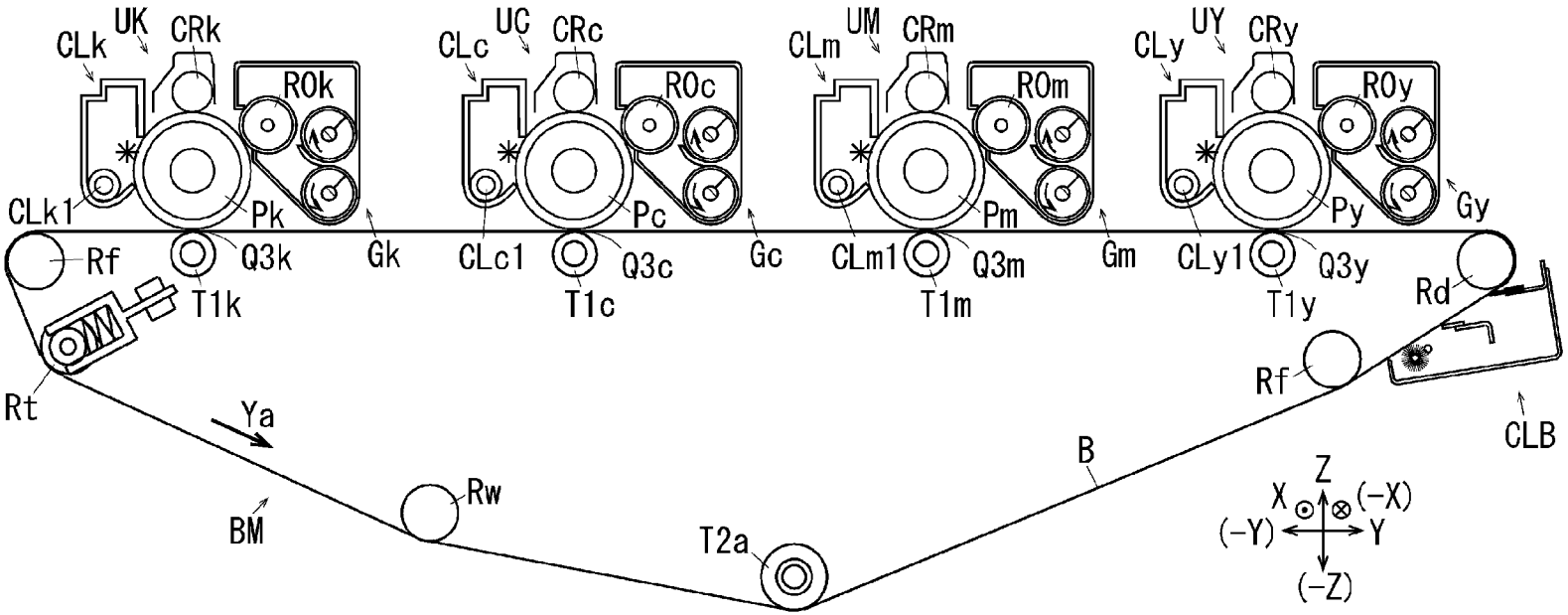
FIG. 2 is an enlarged view of a visible-image forming apparatus according to the example 1.

FIG. 2 is an enlarged view of a visible-image forming apparatus according to the example 1.

In FIG. 1, an image forming apparatus U, serving as an example of an image forming apparatus, includes a user interface UI, serving as an example of an operator, an scanning unit U1, serving as an example of an image reading unit, a feeder unit U2, serving as an example of a medium feeder, an image forming unit U3, serving as an example of an image recording device, and a medium processing device U4.

Description of User Interface UI

The user interface UI includes an input button UIa, used to start copying or determining the number of sheets to be copied. The user interface UI includes a display unit UIb, which displays the contents input through the input button UIa or the state of the copying machine U.

Description of Feeder Unit U2

In FIG. 1, the feeder unit U2 includes sheet feeding trays TR1, TR2, TR3, and TR4, serving as examples of a medium container. The feeder unit U2 also includes a medium feed path SH1. Along the medium feed path SH1, recording sheets S, which are accommodated in and picked up from the sheet feeding trays TR1 to TR4, are transported to the image forming unit U3. The recording sheets S are examples of media for image recording.

Description of Image Forming Unit U3 and Medium Processing Device U4

In FIG. 1, the image forming unit U3 includes an image recording unit U3*a*, which records images on the recording sheets S transported from the feeder unit U2 based on a document image read by the scanning unit U1.

In FIGS. 1 and 2, a driving circuit D of a latent-image forming device of the image forming unit U3 outputs driving signals corresponding to image information input from the scanning unit U1 to latent-image forming devices ROSy, ROSm, ROSc, and ROSk for the corresponding colors Y, M, C, and K at predetermined timing. The latent-image forming devices ROSy, ROSm, ROSc, and ROSk are examples of latent-image forming members. Below the latent-image forming devices ROSy to ROSk, photoconductor drums Py, Pm, Pc, and Pk, which are examples of image carriers, are disposed.

The surfaces of the rotating photoconductor drums Py, Pm, Pc, and Pk are uniformly charged by charging rollers CRy, CRm, CRc, and CRk, which are examples of charging devices. The photoconductor drums Py to Pk having their surfaces charged allow electrostatic latent images to be formed on their surfaces by laser beams Ly, Lm, Lc, and Lk, serving as examples of latent-image writing light beams output by the latent-image forming devices ROSy, ROSm, ROSc, and ROSk. The electrostatic latent images on the surfaces of the photoconductor drums Py, Pm, Pc, and Pk are developed by developing devices Gy, Gm, Gc, and Gk into toner images of yellow Y, magenta M, cyan C, and black K, which are examples of visible images. The developing devices Gy, Gm, Gc, and Gy are examples of developing members.

The developing devices Gy to Gk receive an amount of developer corresponding to the amount consumed through development from toner cartridges Ky, Km, Kc, and Kk, which are examples of developer containers. The toner cartridges Ky, Km, Kc, and Kk are detachably attached to a developer dispenser U3*b*.

The toner images on the surfaces of the photoconductor drums Py, Pm, Pc, and Pk are sequentially superposed on and transferred to an intermediate transfer belt B, serving as an example of an intermediate transfer body, in first transfer areas Q3*y*, Q3*m*, Q3*c*, and Q3*k* by first transfer rollers T1*y*, T1*m*, T1*c*, and T1*k*, serving as examples of first transfer members, so that a color toner image, which is an example of a multicolor visible image, is formed on the intermediate transfer belt B. The color toner image formed on the intermediate transfer belt B is transported to a second transfer area Q4.

In the case of using image data for only black K, the photoconductor drum Pk and the developing device Gk for black K are only used to form only a toner image for the color K.

After first transfer, remnants such as remaining developer or paper dust adhering to the surfaces of the photoconductor drums Py, Pm, Pc, and Pk are removed by drum cleaners CLy, CLm, CLc, and CLk, which are examples of cleaners for image carriers.

In the example 1, the photoconductor drum Pk, the charging roller CRk, and the drum cleaner CLk are integrated into a photoconductor unit UK for the color K, which is an example of an image carrier unit. Similarly, for other colors Y, M, and C, the photoconductor drums Py, Pm, and Pc, the charging rollers CRy, CRm, and CRc, and the drum cleaners CLy, CLm, and CLc form photoconductor units UY, UM, and UC.

The photoconductor unit UK for the color K and the developing device Gk including a development roller ROk, which is an example of a developer holder, form a visible-image forming apparatus UK+Gk for the color K. Similarly, the photoconductor units UY, UM, and UC for the colors Y, M, and C and the developing devices Gy, Gm, and Gc respectively including development rollers R0*y*, R0*m*, and R0*c* form visible-image forming apparatuses UY+Gy, UM+Gm, and UC+Gc for the colors Y, M, and C.

A belt module BM, serving as an example of an intermediate transfer member, is disposed below the photoconductor drums Py to Pk. The belt module BM includes the intermediate transfer belt B, serving as an example of an image carrier member, a driving roller Rd, serving as an example of a member driving an intermediate transfer body, a tension roller Rt, serving as an example of a tensioning member, a walking roller Rw, serving as an example of a weaving prevention member, multiple idler rollers Rf, serving as examples of driven members, a back-up roller T2*a*, serving as an example of an opposing member, and the first transfer rollers T1*y*, T1*m*, T1*c*, and T1*k*. The intermediate transfer belt B is supported to be rotatable in the direction of arrow Ya.

A second transfer unit Ut is disposed below the back-up roller T2*a*. The second transfer unit Ut includes a second transfer belt BTB, serving as an example of an endless member, and a second transfer roller T2*b*, serving as an example of a second transfer member. The area over which the second transfer roller T2*b* comes into contact with the intermediate transfer belt B with the second transfer belt BTB interposed therebetween forms the second transfer area Q4. The second transfer roller T2*b* opposes the back-up roller T2*a*, which is an example of an opposing member, with a second transfer belt BTB and the intermediate transfer belt B interposed therebetween. A contract roller T2*c*, serving as an example of a power feeder, is in contact with the back-up roller T2*a*. The contract roller T2*c* receives a second transfer voltage having a polarity the same as that with which toner is charged.

The back-up roller T2*a*, the second transfer roller T2*b*, and the contract roller T2*c* form a second transfer device T2, serving as an example of a second transfer member.

A medium transport path SH2 is disposed below the belt module BM. The recording sheets S fed from the sheet feeding path SH1 of the feeder unit U2 are transported to registration rollers Rr, which are examples of members that adjust transport timing, by transport rollers Ra, serving as examples of medium transport members. The registration rollers Rr transport the recording sheets S downstream at the right timing when a toner image formed on the intermediate transfer belt B is transported to the second transfer area Q4. The recording sheet S transported by the registration rollers Rr is guided by a sheet guide SGr in front of the registration rollers and a sheet guide SG1 before transfer to the second transfer area Q4.

The toner image on the intermediate transfer belt B is transferred to the recording sheet S by the second transfer device T2 while passing the second transfer area Q4. In the case of forming a color toner image, toner images superposed on and first-transferred to the surface of the intermediate transfer belt B are collectively second-transferred to the recording sheet S.

The first transfer rollers T1*y* to T1*k*, the second transfer device T2, and the intermediate transfer belt B form a transfer device T1*y*–T1*k*+T2+B of the example 1, serving as an example of a transfer member.

The intermediate transfer belt B after the second transfer is cleaned by a belt cleaner CLB, serving as an example of an intermediate-transfer-body cleaner, disposed downstream of the second transfer area Q4. The belt cleaner CLB, serving as an example of a remover, removes remnants in the second transfer area Q4, such as paper dust or developer left without being transferred, from the intermediate transfer belt B.

The recording sheet S to which a toner image has been transferred is transported to a medium transport belt BH, serving as an example of a medium transport device. The medium transport belt BH transports the recording sheet S to a fixing device F.

The fixing device F, serving as an example of a fixing member, includes a heating roller Fh, serving as an example of a heating member, and a pressing roller Fp, serving as an example of a pressing member. The recording sheet S is transported to a fixing area Q5, where the heating roller Fh and the pressing roller Fp are in contact with each other. While passing the fixing area Q5, the toner image on the recording sheet S is heated and pressed by the fixing device F to be fixed to the recording sheet S.

The visible-image forming apparatuses UY+Gy to UK+Gk, the transfer device T1*y*–T1*k*+T2+B, and the fixing device F form the image recording unit U3*a*, serving as an example of an image forming member of the example 1.

A switching gate GT1, serving as an example of a switching member, is disposed downstream of the fixing device F. The switching gate GT1 selectively switches a path for the recording sheet S passing the fixing area Q5, between a sheet discharge path SH3 and a sheet reverse path SH4 of the medium processing device U4. The recording sheet S transported to the sheet discharge path SH3 is transported to a medium transport path SH5 of the medium processing device U4. A curl correction member U4*a*, serving as an example of a warp correction member, is disposed on the medium transport path SH5. The curl correction member U4*a* corrects warpage, or so-called a curl of the recording sheet S transported thereto. The recording sheet S having its curl corrected is discharged to a discharge tray TH1, serving as an example of a medium discharge portion, with discharge rollers Rh while having its image fixed surface facing up. The discharge rollers Rh serve as examples of medium discharge members.

The recording sheet S transported to the reversing path SH4 of the image forming unit U3 by the switching gate GT1 is transported through a second gate GT2, serving as an example of a switching member, to the reversing path SH4 of the image forming unit U3.

Here, when the recording sheet S is to be discharged while having its image fixed surface facing down, the transport direction of the recording sheet S is reversed after the trailing end of the recording sheet S in the transport direction passes the second gate GT2. Here, the second gate GT2 according to the example 1 is formed from a thin elastic member. Thus, the second gate GT2 allows the recording sheet S transported to the reversing path SH4 to pass therethrough once, and then guides the recording sheet S that has passed therethrough and then reversed or transported backward to the transport paths SH3 and SH5. The recording sheet S transported backward passes the curl correction member U4*a*, and is discharged to the discharge tray TH1 while having its image fixed surface facing down.

A circuit SH6 is connected to the reversing path SH4 of the image forming unit U3, and a third gate GT3, serving as an example of a switching member, is disposed at the connection portion. A downstream end of the reversing path SH4 is connected to a reversing path SH7 of the medium processing device U4.

The recording sheet S transported through the switching gate GT1 to the reversing path SH4 is allowed by the third gate GT3 to be transported to the reversing path SH7 of the medium processing device U4. As in the case of the second gate GT2, the third gate GT3 according to the example 1 is formed from a thin elastic member. Thus, the third gate GT3 allows the recording sheet S transported from the reversing path SH4 to pass therethrough once, and guides the recording sheet S that has passed therethrough and transported backward to the circuit SH6.

The recording sheet S transported to the circuit SH6 is transported again to the second transfer area Q4 through the medium transport path SH2 to have its second surface subjected to printing.

Components denoted with the reference signs SH1 to SH7 form a medium transport path SH. The components denoted with the reference signs SH, Ra, Rr, Rh, SGr, SG1, BTB, BH, and GT1 to GT3 form a sheet transport device SU according to the example 1.

Description of Adjusting Mechanism

Figure 3:
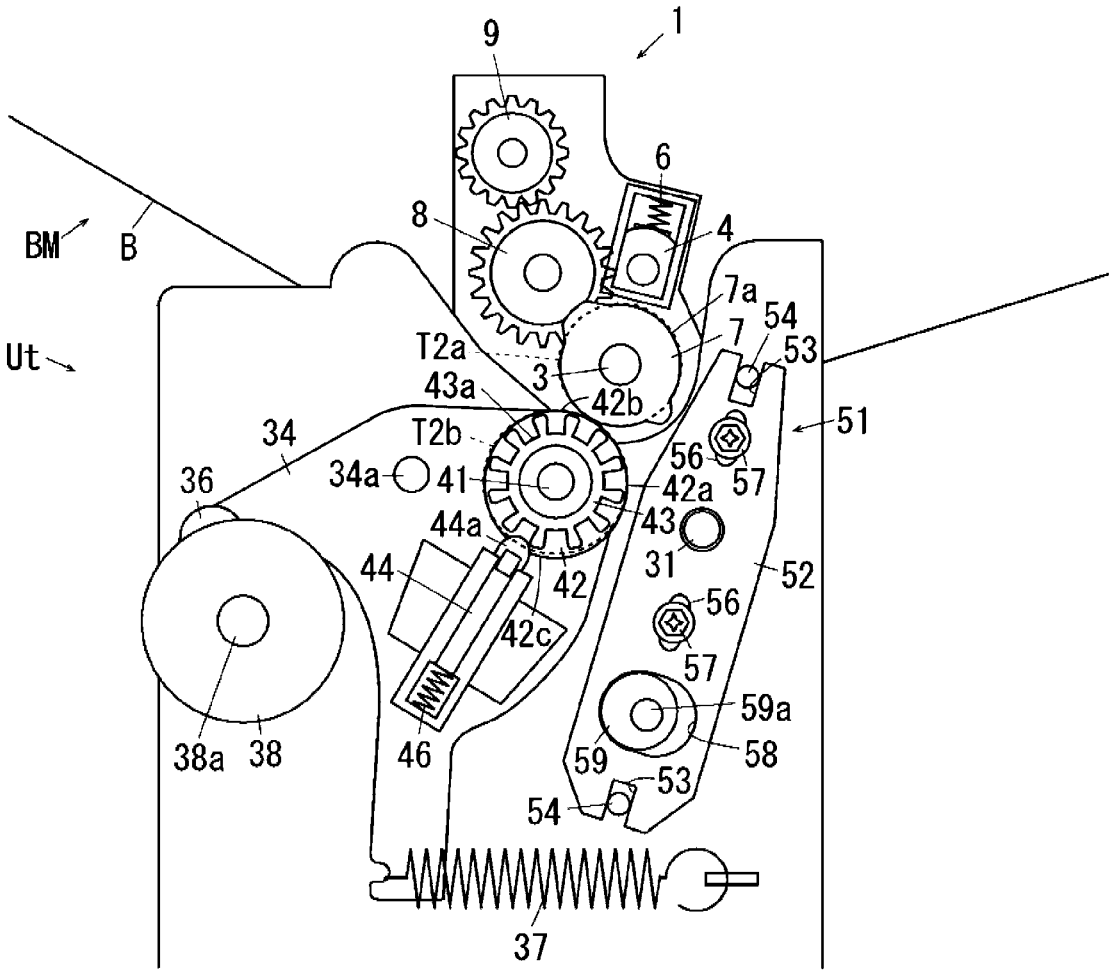
FIG. 3 illustrates an adjusting mechanism of the example 1.

FIG. 3 illustrates an adjusting mechanism of the example 1.

Figure 4:
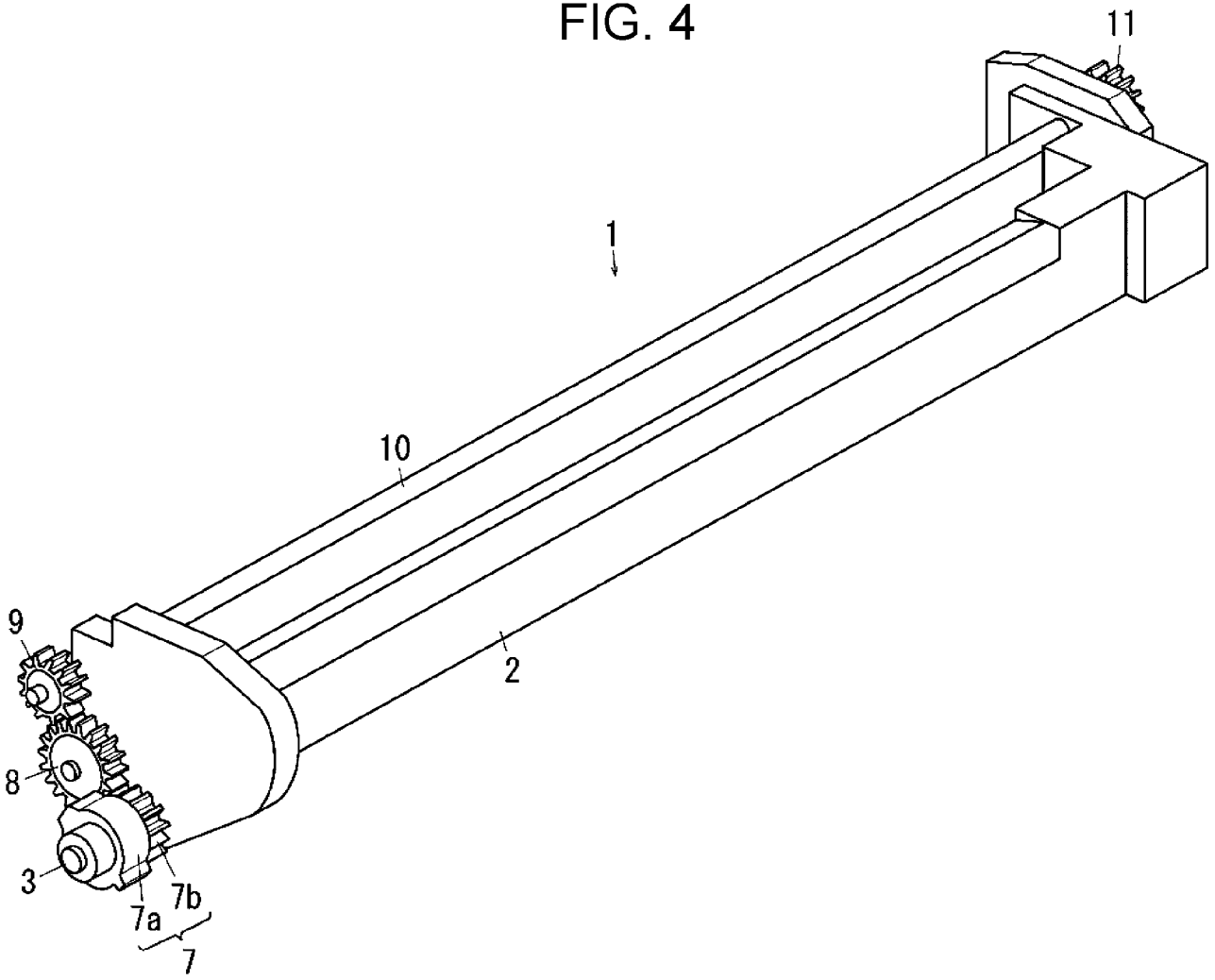
FIG. 4 illustrates a back-up roll unit.

FIG. 4 illustrates a back-up roll unit.

In FIG. 3, a back-up roll unit 1, serving as an example of a first adjusting unit, is supported below the belt module BM, serving as an example of a first unit. The back-up roll unit 1 includes the back-up roller T2*a*, serving as an example of a first rotating member, and a housing 2, which covers the upper side and both end portions of the back-up roller T2*a* in the axial direction. At front and rear end portions of the housing 2, a bearing member 4 that supports a rotation shaft 3 of the back-up roller T2*a* is supported to be movable toward and away from the second transfer roller T2*b*. Between the bearing member 4 and the housing 2, a coil spring 6, serving as an example of an urging member, is attached. The coil spring 6 exerts a force of pushing the back-up roller T2*a* against the second transfer roller T2*b*.

On front and rear end surfaces of the housing 2, switching cams 7, serving as examples of first eccentric members, are supported concentric with the rotation shaft 3 of the back-up roller T2*a*. FIGS. 3 and 4 illustrate only the switching cam 7 at the front, but this structure also has a similar switching cam 7 at the rear. Each switching cam 7 has an outer surface 7*a*, which has an outer diameter changing as it extends in the circumferential direction. Each switching cam 7 is formed from a so-called eccentric cam.

The switching cam 7 includes a gear unit 7*b*, serving as an example of a gear. The gear unit 7*b* is engaged with a first intermediate gear 8, serving as an example of a gear. The first intermediate gear 8 is rotatably supported by the outer surface of the housing 2.

The first intermediate gear 8 is engaged with a first transmission gear 9, serving as an example of a gear. The first intermediate gear 8 supports a transmission shaft 10, serving as an example of a transmission member. The transmission shaft 10 extends in the front-rear direction and is rotatably supported by front and rear ends of the housing 2.

The rear end of the transmission shaft 10 supports a driven gear 11, serving as an example of a gear. The driven gear 11 is engaged with a rear intermediate gear, not illustrated. The rear intermediate gear is engaged with the gear unit of the switching cam, not illustrated.

The driven gear 11 receives driving power from a driving gear, not illustrated, installed in the body of the copying machine U. When driving power is transmitted to the driven gear 11, the front switching cam 7 rotates via the transmission shaft 10, the first transmission gear 9, and the first intermediate gear 8, and an intermediate gear and a switching cam at the rear not illustrated also rotate.

Components such as the switching cam 7, the first intermediate gear 8, the first transmission gear 9, the transmission shaft 10, and the driven gear 11 form a load adjusting mechanism 7-11, serving as an example of a first adjusting member.

Figure 5:
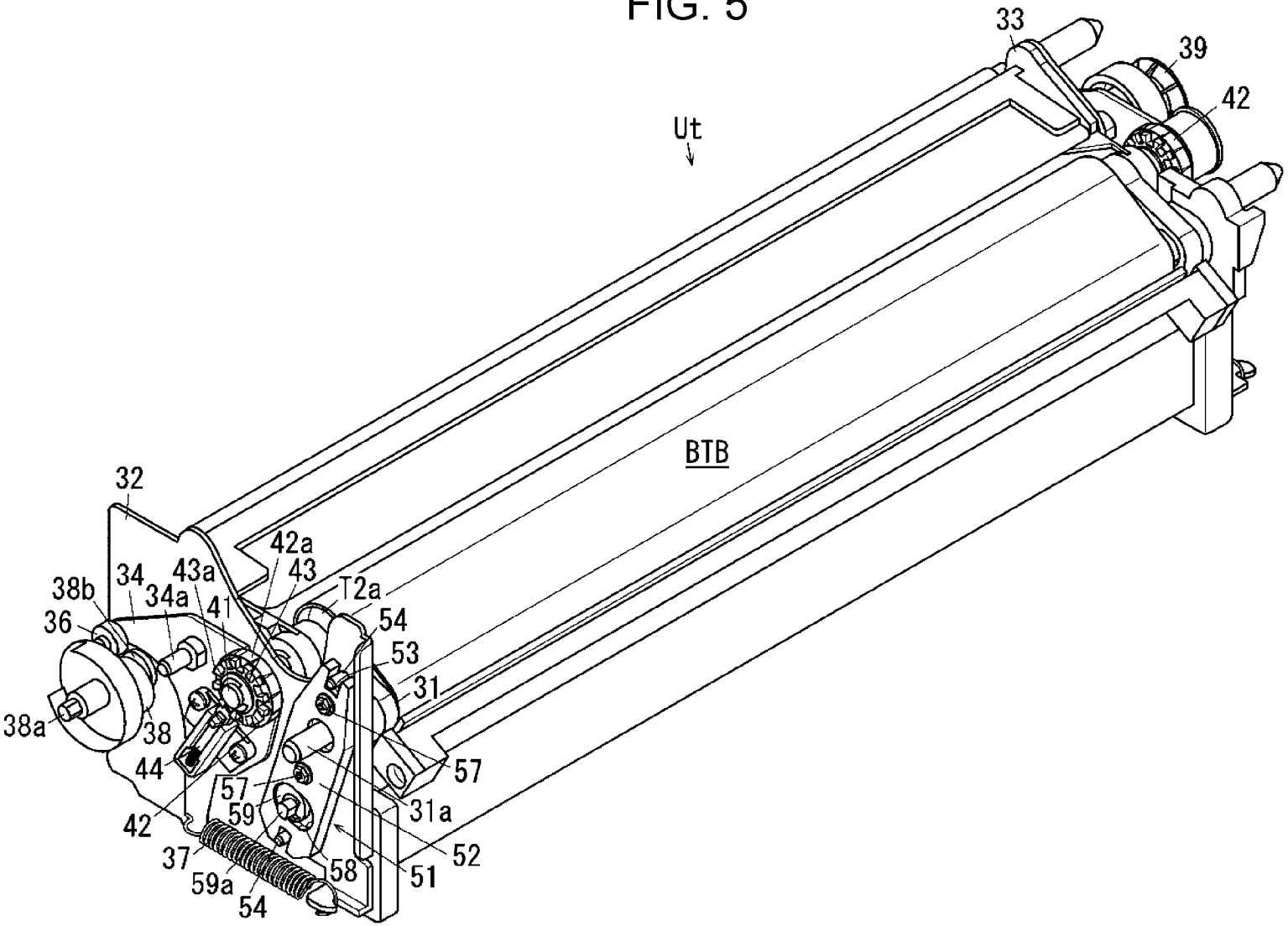
FIG. 5 illustrates a second transfer unit of the example 1.

FIG. 5 illustrates a second transfer unit according to the example 1.

In FIGS. 2 and 3, the second transfer unit Ut, serving as an example of a second unit, is disposed below the belt module BM.

In FIGS. 3 and 5, the second transfer unit Ut includes the second transfer belt BTB, serving as an example of a second belt member. The second transfer belt BTB according to the example 1 is formed from an elastic rubber belt formed from a material with lower solidity and hardness than the intermediate transfer belt B formed from polyimide or polyamide-imide. The second transfer belt BTB is supported while being stretched by a driven roller 31 and the second transfer roller T2*b*, serving as an example of a second rotating member. The second transfer unit Ut includes a pair of front and rear frames 32 and 33, serving as examples of frames.

On the front surface of the front frame 32, a support plate 34, serving as examples of movable support members, is supported. The support plate 34 is rotatably supported by the front frame 32 while having a movable shaft 34*a* at the center. The support plate 34 supports the second transfer roller T2*b* on the right of the movable shaft 34*a*. The support plate 34 supports a cam follower 36, serving as an example of an operable member, on the left of the movable shaft 34*a*. An end of a coil spring 37, serving as an example of an urging member, is connected to the support plate 34 below the movable shaft 34*a*. Another end of the coil spring 37 is supported by the front frame 32. The coil spring 37 of the example 1 pulls the lower end of the support plate 34 rightward to exert a force in the direction of urging the second transfer roller T2*b* toward the back-up roller T2*a*.

A retract cam 38, serving as an example of a separation member, is supported by the front frame 32 below the cam follower 36 to be rotatable about a cam shaft 38*a*. The retract cam 38 includes a contact portion 38*b* that is eccentric with respect to the cam shaft 38*a* and that comes into contact with the cam follower 36. The cam shaft 38*a* of the retract cam 38 extends to a rear end of the second transfer unit Ut. At the rear end of the cam shaft 38*a*, a retract gear 39, serving as an example of a driving-power transmission member, is supported. The retract gear 39 is capable of receiving driving power from a driving-power source, not illustrated, in the copying machine U.

The support plate 34, the cam follower 36, the coil spring 37, and the retract cam 38 are supported by the rear frame 33, besides the front frame 32. Via the cam shaft 38*a*, the front and rear retract cams 38 rotate in an interlocking manner.

Components denoted with reference signs 34 to 39 form a retract mechanism 34-39 according to the example 1, serving as an example of a separating-approaching member.

At a front end portion of a shaft 41 of the second transfer roller T2*b*, a fine-adjustment cam 42, serving as an example of a second eccentric member, is supported. An outer surface 42*a* of the fine-adjustment cam 42 is capable of coming into contact with the outer surface 7*a* of the switching cam 7. The outer surface 42*a* of the fine-adjustment cam 42 has a shape having an outer diameter gradually increasing from a minimum portion 42*b* toward a maximum portion 42*c*. A rugged ring 43, serving as an example of a stoppable member, is disposed in front of the fine-adjustment cam 42. The rugged ring 43 has multiple recesses 43*a* at intervals in the circumferential direction. In the example 1, for example, 12 recesses 43*a* are arranged at intervals of 30°. In the example 1, for example, the outer diameter of the outer surface 42*a* is changed by 75 μm for each recess 43*a*, that is, per 30° in the circumferential direction.

A stop rod 44, serving as an example of a stop member, is disposed below and on the left of the shaft 41 of the second transfer roller T2*b*. The stop rod 44 is rotatably supported by the front frame 32. The stop rod 44 according to the example 1 is movable in the direction of the line connecting the rotation shaft 3 of the back-up roller T2*a* and the shaft 41 of the second transfer roller T2*b*. The stop rod 44 has a semicircular far end 44*a*. The far end 44*a* receives a force toward the rugged ring 43 from a spring 46, serving as an example of an urging member.

Components denoted with reference signs 42 to 46 form a fine-adjustment mechanism 42-46, serving as an example of a second adjusting member.

In the example 1, the fine-adjustment mechanism 42-46 are disposed at the front and rear of the second transfer unit Ut. Unlike the retract mechanisms 34-39 that move in an interlocking manner, the front and rear fine-adjustment mechanisms 42-46 operate individually.

In the second transfer unit Ut, walk adjusting mechanisms 51, serving as examples of prevention members, are disposed at front and rear ends of a driven shaft 31*a* of the driven roller 31 of the second transfer belt BTB. Each walk adjusting mechanism 51 includes an adjusting plate 52, serving as an example of a prevention member body. The adjusting plates 52 are disposed on the outer surfaces of front and rear frames 32 and 33. The adjusting plates 52 of the example 1 are plates extending in the vertical direction. The adjusting plates 52 rotatably support the outer ends of the driven shaft 31*a*. The walk adjusting mechanisms 51 are disposed at the front and at the rear. In the following description, only the walk adjusting mechanism 51 at the front side will be described in detail without describing in detail the walk adjusting mechanism 51 at the rear, which is similar to that at the front side.

Guide grooves 53, serving as examples of to-be-guided portions, are disposed at upper and lower end portions of each adjusting plate 52. Guide protrusions 54, serving as examples of guiding members, are fitted into the guide grooves 53. The guide protrusions 54 protrude outward from the front and rear frames 32 and 33. Thus, the guide grooves 53 and the guide protrusions 54 allow the adjusting plate 52 to move in the direction parallel to the guide grooves 53.

Fastening holes 56, serving as examples of to-be-fastened members, are formed at upper and lower portions of the driven shaft 31*a*. The fastening holes 56 are long holes extending in the direction in which the adjusting plate 52 moves. Screws 57, serving as examples of fastening members, extend through the fastening holes 56. The screws 57 are screwed into the front frame 32. Thus, when the screws 57 are fastened, the screw heads come into contact with the adjusting plate 52 to fix the adjusting plate 52 immovable. When the screws 57 are unfastened, the adjusting plate 52 is allowed to move along the guide grooves 53.

Below the lower fixing hole 56, a cam follower hole 58, serving as an example of an operable member, is formed. The cam follower hole 58 is a long hole extending in the cross direction of the adjusting plate 52. The cam follower hole 58 accommodates a walk adjustment cam 59, serving as an example of an operation member and a third eccentric member. The walk adjustment cam 59 has a rotation shaft 59*a* rotatably supported by the front frame 32. The walk adjustment cam 59 is formed from a so-called eccentric cam having an outer diameter substantially elliptic with respect to the rotation shaft 59*a*. The walk adjustment cam 59 is rotatable by a user rotating the rotation shaft 59*a* with his/her fingers or a device.

Components denoted with the reference signs 52 to 59 form a walk adjusting mechanism 51 according to the example 1.

Operations of Example 1

When the copying machine U according to the example 1 having the above structure is to form an image, the retract mechanism 34-39 moves the second transfer roller T2*b* closer to the back-up roller T2*a* to bring the intermediate transfer belt B, serving as an example of a belt member, and the second transfer belt BTB, serving as an example of a second belt member, into contact with each other. In this state, the copying machine U transfers the image to the recording sheet S that passes the second transfer area Q4. In the example 1, the second transfer belt BTB is spaced apart from the intermediate transfer belt B when the printing operation is finished. Specifically, driving power is transmitted to the retract cam 38 through the retract gear 39, the contact portion 38*b* rotates to push the cam follower 36 upward, and the coil spring 37 is stretched to move the second transfer roller T2*b* away from the back-up roller T2*a*. The second transfer belt BTB supported by the second transfer roller T2*b* is thus also spaced apart from the intermediate transfer belt B. In the example 1, the front and rear support plates 34 move in an interlocking manner via the cam shaft 38*a*. Thus, the front and rear ends of the shaft 41 of the second transfer roller T2*b* concurrently move toward and away from the back-up roller T2*a*.

When a thick paper sheet is used as the recording sheet S in a printing operation, a medium thicker than an ordinary sheet enters between the intermediate transfer belt B and the second transfer belt BTB, and may cause an excessive contact pressure or load. To address this situation, in the example 1, the load adjusting mechanism 7-11 operates for a thick sheet to move the back-up roller T2*a* away from the second transfer roller T2*b* to reduce the load. When, on the other hand, the recording sheet S is changed from a thick sheet back to an ordinary sheet, the load adjusting mechanism 7-11 operates to move the back-up roller T2*a* toward the second transfer roller T2*b* to increase the load. Specifically, in the load adjusting mechanism 7-11 according to the example 1, when driving power is transmitted to the driven gear 11, the switching cam 7 rotates to change the position of the outer surface 7*a* that comes into contact with the outer surface 42*a* of the fine-adjustment cam 42. Thus, the relative position where the back-up roller T2*a* coaxial with the switching cam 7 faces the second transfer roller T2*b* changes. Thus, the distance or positional relationship between the back-up roller T2*a*, serving as an example of a first rotating member, and the second transfer roller T2*b*, serving as an example of a second rotating member, changes, and a so-called thrust changes. Thus, the contact pressure and the load in the second transfer area Q4 change.

In the copying machine U according to the example 1, due to the individual differences, manufacturing errors, assembly errors, or wear over time, the positional relationship between the back-up roller T2*a* and the second transfer roller T2*b*, specifically, parallelism microscopically deviates from the designed ideal state. The parallelism is an index of how much the axial direction of the rotation shaft 3 of the back-up roller T2*a* and the axial direction of the shaft 41 of the second transfer roller T2*b* deviate from the state where they are parallel to each other. When the parallelism deviates from the designed value, the pressure distribution in the width direction of the recording sheet S in the second transfer area Q4 changes, transfer defects such as uneven transfer occur, the recording sheet S may move obliquely with respect to the transport direction while travelling, the recording sheet S may be creased, or the intermediate transfer belt B or the second transfer belt BTB may weave or deviate. To address this, the example 1 includes the fine-adjustment mechanisms 42-46. In the fine-adjustment mechanisms 42-46 according to the example 1, when a user rotates the fine-adjustment cam 42 with his/her hand or a device, the outer surface 42*a* of the fine-adjustment cam 42 rotates to change the position where it comes contact with the outer surface 7*a* of the switching cam 7. Thus, the outer diameter of the fine-adjustment cam 42 that comes into contact with the switching cam 7 changes, and the distance between the second transfer roller T2*b* coaxial with the fine-adjustment cam 42 and the back-up roller T2*a* coaxial with the switching cam 7 changes. In the example 1, the fine-adjustment mechanisms 42-46 are disposed at the front and the rear, and separately operable. Thus, the distance between the second transfer roller T2*b* and the back-up roller T2*a* is individually adjustable at the front side, serving as an example of a first end side, and at the rear side, serving as an example of a second end side. Thus, the parallelism between the second transfer roller T2*b* and the back-up roller T2*a* is adjustable.

The second transfer unit Ut according to the example 1 is removable from the copying machine U when the retract mechanism 34-39 operates and the second transfer belt BTB is spaced apart from the intermediate transfer belt B. While the second transfer unit Ut is removed, the front and rear fine-adjustment mechanisms 42-46 of the second transfer unit Ut are individually operable. Thus, the fine-adjustment mechanisms 42-46 are more easily operable than in the case where the fine-adjustment mechanisms 42-46 are not removable from the copying machine U. The fine-adjustment mechanism 42-46 at the front is operable by only opening a front panel (not illustrated) of the copying machine U without removing the second transfer unit Ut from the copying machine U. The fine-adjustment mechanism 42-46 at the rear is operable while the second transfer unit Ut is removed from the copying machine U. Particularly, the second transfer unit Ut is disposed below the belt module BM in the direction of gravitation. Thus, while operating the second transfer unit Ut, a user usually looks down the second transfer unit Ut from above, and is thus capable of operating the second transfer unit Ut while checking the second transfer belt BTB. Thus, the second transfer unit Ut is more easily operable than in the case where a user looks up the second transfer unit Ut while operating.

The second transfer unit Ut may be unremovable. In this case, the structure may exclude the fine-adjustment mechanism 42-46 at the rear. Specifically, in the example 1, the fine-adjustment mechanisms 42-46 at the front and rear are both adjustable, but this is not the only possible structure. For example, the parallelism may be adjustable while the fine-adjustment mechanism 42-46 at the rear is non-adjustable, that is, the distance between the second transfer roller T2*b* and the back-up roller T2*a* is fixed, by adjusting only the fine-adjustment mechanism 42-46 at the front to change the relative distance from the fine-adjustment mechanism 42-46 at the front to the fine-adjustment mechanism 42-46 at the rear. However, in this structure, the adjustable range is often narrower than the structure where the fine-adjustment mechanisms 42-46 at the front and rear are both adjustable. To address this, preferably for example, the rate of an increase of the outer diameter of the outer surface 42*a* may be increased, or the number of recesses 43*a* may be increased.

Here, in the structure described in Japanese Unexamined Patent Application Publication No. 2017-68186, the moving mechanism (100) corresponding to the fine-adjustment mechanism 42-46 according to the example 1 is disposed closer to the belt module. Specifically, in Japanese Unexamined Patent Application Publication No. 2017-68186, the parallelism between the second transfer roller (154) and the back-up roller (165) is adjusted by, and walk of the second transfer belt (153) is controlled by adjusting the back-up roller (165) on the opposing intermediate transfer belt (151). The walk of the second transfer belt (153) is also affected by the parallelism between a separation roller (155) and the second transfer roller (154) that stretches the second transfer belt (153). Thus, the adjustment of the parallelism of the back-up roller (165) and the control of walk may contradict, so that when one of parallelism and walk improves, the other may degrade. To adjust the walk of the second transfer belt (153) using the back-up roller (165), a change of the contact state of the second transfer belt (153) is more likely to affect the adjustment of the walk. Thus, in the structure described in Japanese Unexamined Patent Application Publication No. 2017-68186, an adjustment of the contact pressure in the second transfer area using the second transfer belt (153) hinders the adjustment of the walk. Commercially available image forming apparatuses thus include a parallelism adjusting mechanism and a contact-pressure adjusting mechanism on the belt module while allowing the back-up roller (165) in the moving mechanism (100) to move toward or away from the second transfer roller (154) besides in the horizontal direction.

However, the structure in which the parallelism adjusting mechanism and the contact-pressure adjusting mechanism are disposed on the belt module is complex. In this structure, an adjustment of one of the parallelism and the contact pressure affects an adjustment of the other. This structure thus fails to improve the accuracy of adjustments of parallelism and contact pressure.

In the example 1, on the other hand, the load adjusting mechanism 7-11 disposed on the belt module BM is capable of adjusting the load between the back-up roller T2*a* and the second transfer roller T2*b*, and the fine-adjustment mechanism 42-46 disposed on the second transfer unit Ut is capable of adjusting the parallelism between the back-up roller T2*a* and the second transfer roller T2*b*. Thus, the example 1 is capable of separately adjusting the load and the parallelism, and the adjustment of one of the load and the parallelism is less likely to affect the adjustment of the other. Thus, the example 1 is capable of more accurately adjusting the parallelism and the load than the structure where the load adjusting mechanism 7-11 and the fine-adjustment mechanism 42-46 are disposed on the belt module BM.

Particularly, in the example 1, the switching cam 7 is coaxial with the back-up roller T2*a*. In the structure described in Japanese Unexamined Patent Application Publication No. 2017-68186, component errors or assembly errors are more likely to affect the adjustment of the back-up roller (165) when a guide long hole (104d) of a support plate (101) is spaced further from the back-up roller (165). In the example 1, in contrast, the switching cam 7 and the back-up roller T2*a* are coaxial and located close to each other. The example 1 thus easily improves the accuracy of adjusting the load.

Similarly, in the example 1, the fine-adjustment cam 42 is coaxial with the second transfer roller T2*b*. The example 1 thus more easily improves the accuracy of adjusting the parallelism than in the structure where the fine-adjustment cam 42 is spaced further from the second transfer roller T2*b*.

The example 1 includes the second transfer belt BTB. Compared to the structure not including the second transfer belt BTB, the example 1 allows the recording sheet S to stably keep its position in the second transfer area Q4 without causing transfer errors. Particularly, in the fine-adjustment mechanism 42-46 disposed on the second transfer unit Ut, the parallelism of the second transfer roller T2*b* is accurately adjusted, while keeping stable transport with the second transfer belt BTB.

In the example 1, the second transfer belt BTB includes a walk adjusting mechanism 51. In the walk adjusting mechanism 51 of the example 1, to reduce weaving or deviation of the second transfer belt BTB, the driven shaft 31*a* is inclined in such a direction as to cancel the deviation. Specifically, when the walk adjustment cam 59 is rotated while the screws 57 are unfastened, the adjusting plates 52 move and the driven shaft 31*a* supported by the adjusting plates 52 moves. By adjusting the relative position of the adjusting plates 52 by changing the respective positions of the front and rear adjusting plates 52, the driven roller 31 is allowed to be inclined in an intended direction. When the screws 57 are fastened, the position of the driven roller 31 is fixed. The walk adjusting mechanism 51 according to the example 1 is capable of adjusting the inclination of the driven shaft 31*a* to reduce weaving or deviation of the second transfer belt BTB in the width direction.

Here, unlike a structure where the single moving mechanism (100) adjusts parallelism and walk, as in the structure described in Japanese Unexamined Patent Application Publication No. 2017-68186, the example 1 is capable of independently and individually performing adjustments using the fine-adjustment mechanism 42-46 and the walk adjusting mechanism 51. In the example 1, the walk adjusting mechanism 51 is disposed at a position separate from the second transfer area Q4 where the fine-adjustment mechanism 42-46 that adjusts parallelism is disposed. Thus, unlike in the structure described in Japanese Unexamined Patent Application Publication No. 2017-68186 in which an adjustment of the parallelism and an adjustment of walk may contradict, the example 1 is capable of securely adjusting parallelism of the second transfer roller T2*b* and adjusting walk of the second transfer belt BTB.

In the example 1, the fine-adjustment cam 42 is held while having the far end 44*a* of the stop rod 44 fitted into the recesses 43*a*. The fine-adjustment cam 42 is held stationary without rotating when a user performs no operation. When the fine-adjustment cam 42 rotates, the spring 46 contracts, the stop rod 44 crosses a protrusion between the adjacent recesses 43*a* to move to the next recess 43*a*, the spring 46 is elastically restored, and the stop rod 44 is fitted into the next recess 43*a*. When a user rotates the fine-adjustment cam 42, the user easily notices the transfer to the next recess 43*a* with resistance of the contracting spring and the click of the stop rod 44 caused when the stop rod 44 fits into the next recess 43*a*. This structure improves the operability compared to the structure not including the recesses 43*a* or the stop rod 44.

In the example 1, the lower second transfer belt BTB has lower solidity and hardness than the upper intermediate transfer belt B. Thus, for example, in the second transfer area Q4 where the second transfer belt BTB and the intermediate transfer belt B come into contact with each other, the second transfer belt BTB with lower solidity is more likely to be displaced when deviation occurs in opposite directions. Thus, the second transfer belt BTB is finely adjusted more frequently. The fine-adjustment mechanism 42-46 disposed on the second transfer unit Ut in the example 1 is more likely to cope with displacement or other defects as appropriate, than in the case where the fine-adjustment mechanism 42-46 is disposed on the belt module BM.

Modification Examples

Thus far, the examples of the present disclosure have been descried in detail. However, the disclosure is not limited to the above-described examples, and may be modified in various manners within the scope of the gist of the present disclosure described in the scope of claims. Modified examples H01 to H011 of the present disclosure are described, below, by way of examples.

H01

In the above examples, a copying machine U is described as an example of an image forming apparatus, but the present disclosure is not limited to this. The present disclosure is applicable to, for example, a FAX machine, or a multifunctional device including multiple functions such as a FAX machine, a printer, and a copying machine. The image forming apparatus is not limited to a multi-color image forming apparatus, and may be a monochrome image forming apparatus.

H02

In the above example, specific numbers described by way of example are changeable as appropriate depending on changes of design or specifications.

H03

In the above example, the load adjusting mechanism 7-11 is disposed on the back-up roller T2*a*, and the fine-adjustment mechanism 42-46 is disposed on the second transfer roller T2*b*. However, this is not the only possible structure. The load adjusting mechanism 7-11 may be disposed on the second transfer roller T2*b*, and the fine-adjustment mechanism 42-46 may be disposed on the back-up roller T2*a*.

H04

The above example preferably includes the second transfer belt BTB. However, a structure not including the second transfer belt BTB may include the load adjusting mechanism 7-11 and the fine-adjustment mechanism 42-46. A structure not including the second transfer belt BTB may omit the walk adjusting mechanism 51.

H05

The above example including the second transfer belt BTB preferably includes the walk adjusting mechanism 51. However, a structure may use the fine-adjustment mechanism 42-46 for adjustment without including the walk adjusting mechanism 51.

H06

The above example includes the load adjusting mechanism 7-11 and the fine-adjustment mechanism 42-46 at portions where the intermediate transfer belt B and the second transfer belt BTB come into contact with each other. However, this is not the only possible structure. For example, the load adjusting mechanism 7-11 and the fine-adjustment mechanism 42-46 may be disposed in any area between two members where the load and parallelism are to be adjusted, such as a contact area between the photoconductor belt and the intermediate transfer belt, a contact area between a pair of fixing belts, a contact area between a pair of transport belts, or an area where the photoconductor drum and the intermediate transfer belt oppose each other.

H07

In the above example, the load adjusting mechanism 7-11 concurrently moves the front and rear end portions of the back-up roller T2*a* with the transmission shaft 10. However, this is not the only possible structure. The front and rear end portions of the back-up roller T2*a* may be moved by individual mechanisms. Here, the mechanisms at the front and rear are preferably moved in an interlocking manner, but may be moved with a time lag.

H08

In the above example, the load adjusting mechanism 7-11 including the switching cam 7 as an operator is described by way of example. However, this is not the only possible structure. Instead of an eccentric cam, a structure such as a motor and a gear, a solenoid, or a spring may be employed. Instead of a structure of adjusting the positions between the shafts, the load may be adjusted by changing the amount of elastic deformation of a coil spring that is pushed against another. Nevertheless, an eccentric cam easily enables a simple structure and reduction of manufacturing costs.

The fine-adjustment cam 42 of the fine-adjustment mechanism 42-46 may be similarly changed to another device such as a motor and a gear.

H09

In the above example, the walk adjusting mechanism 51 substantially vertically moves the driven roller 31, by way of example. However, this is not the only possible structure. The driven roller 31 may be substantially horizontally moved, instead.

H010

In the above example, the second transfer belt BTB is preferably formed from a rubber belt having lower solidity than the intermediate transfer belt B, but this is not the only possible structure. The second transfer belt BTB may be formed from the same material as the intermediate transfer belt B, or a material having higher solidity than the intermediate transfer belt B.

H011

In the above example, the belt module BM is disposed on the upper side and the second transfer unit Ut is disposed on the lower side. However, this is not the only possible structure. The belt module BM and the second transfer unit Ut may be vertically reversed, or may be arranged side by side in the horizontal direction.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus, comprising:

a first unit that includes an endless first belt member and a first rotating member that rotates while supporting the first belt member;

a second unit that includes:

a rotatable second rotating member that opposes the first rotating member with the first belt member interposed therebetween;

an endless second belt member that rotates while being supported by the second rotating member; and a prevention member that prevents deviation of the second belt member in a width direction;

a first adjusting member that is disposed on the first unit to adjust a load between the first rotating member and the second rotating member by adjusting a distance to the second unit; and a second adjusting member that is disposed on the second unit to adjust parallelism between the first rotating member and the second rotating member by adjusting a distance to the first unit, and the second adjusting member adjusts the distance by a smaller amount than the first adjusting member.

2. The image forming apparatus according to claim 1, wherein the first belt member has a surface on which an image is held, and wherein the second belt member transports a medium while transferring the image to the medium from the surface of the first belt member.

3. The image forming apparatus according to claim 1, wherein the first adjusting member adjusts the load by adjusting positions of both end portions of a rotation shaft of either one of the first rotating member and the second rotating member.

4. The image forming apparatus according to claim 2, wherein the first adjusting member adjusts the load by adjusting positions of both end portions of a rotation shaft of either one of the first rotating member and the second rotating member.

5. The image forming apparatus according to claim 3, wherein the first adjusting member includes first eccentric members supported at both end portions of the rotation shaft of the rotating member, and adjusts the positions of both end portions of the rotation shaft of the either one of the first rotating member and the second rotating member by adjusting a distance to the second unit with rotation of the first eccentric members.

6. The image forming apparatus according to claim 4, wherein the first adjusting member includes first eccentric members supported at both end portions of the rotation shaft of the rotating member, and adjusts the positions of both end portions of the rotation shaft of the either one of the first rotating member and the second rotating member by adjusting a distance to the second unit with rotation of the first eccentric members.

7. The image forming apparatus according to claim 1, wherein the second adjusting member adjusts the parallelism by adjusting a position of a first end portion of a rotation shaft of the other one of the first rotating member and the second rotating member.

8. The image forming apparatus according to claim 7, wherein the second adjusting member includes a second eccentric member supported by the rotation shaft of the rotating member, and adjusts the position of the first end portion of the rotation shaft of the other one of the first rotating member and the second rotating member by adjusting a distance to the first unit from the first end portion with a rotation of the second eccentric member.

9. The image forming apparatus according to claim 1, wherein the first adjusting member is disposed on the first unit, and wherein the second adjusting member is disposed on the second unit.

10. The image forming apparatus according to claim 1, wherein the second unit is disposed below the first unit in a direction of gravitation, and removable from a body of the image forming apparatus.

11. An image forming apparatus, comprising:

a first unit that includes an endless first belt member and a first rotating member that rotates while supporting the first belt member;

a second unit that includes:

a rotatable second rotating member that opposes the first rotating member with the first belt member interposed therebetween; and an endless second belt member that rotates while being supported by the second rotating member, and the second belt member has lower solidity than the first belt member of the first unit;

a first adjusting member that is disposed on the first unit to adjust a load between the first rotating member and the second rotating member by adjusting a distance to the second unit; and a second adjusting member that is disposed on the second unit to adjust parallelism between the first rotating member and the second rotating member by adjusting a distance to the first unit, and the second adjusting member adjusts the distance by a smaller amount than the first adjusting member.

12. The image forming apparatus according to claim 11, wherein the second unit includes a prevention member that prevents deviation of the second belt member in a width direction.

13. The image forming apparatus according to claim 11, wherein the first belt member has a surface on which an image is held, and the second belt member transports a medium while transferring the image to the medium from the surface of the first belt member.

14. The image forming apparatus according to claim 11, wherein the first adjusting member adjusts the load by adjusting positions of both end portions of a rotation shaft of either one of the first rotating member and the second rotating member.

15. The image forming apparatus according to claim 14, wherein the first adjusting member includes first eccentric members supported at both end portions of the rotation shaft of the rotating member, and adjusts the positions of both end portions of the rotation shaft of the either one of the first rotating member and the second rotating member by adjusting a distance to the second unit with rotation of the first eccentric members.

16. The image forming apparatus according to claim 11, wherein the second adjusting member adjusts the parallelism by adjusting a position of a first end portion of a rotation shaft of the other one of the first rotating member and the second rotating member.

17. The image forming apparatus according to claim 16, wherein the second adjusting member includes a second eccentric member supported by the rotation shaft of the rotating member, and adjusts the position of the first end portion of the rotation shaft of the other one of the first rotating member and the second rotating member by adjusting a distance to the first unit from the first end portion with a rotation of the second eccentric member.

18. The image forming apparatus according to claim 11, wherein the second unit is disposed below the first unit in a direction of gravitation, and removable from a body of the image forming apparatus.

19. An image forming apparatus, comprising:

a first unit that includes an endless first belt member and a first rotating member that rotates while supporting the first belt member;

a second unit that includes a rotatable second rotating member that opposes the first rotating member with the first belt member interposed therebetween;

a first adjusting member that is disposed on the first unit to adjust a load between the first rotating member and the second rotating member by adjusting a distance to the second unit; and a second adjusting member that is disposed on the second unit to adjust parallelism between the first rotating member and the second rotating member by adjusting a distance to the first unit, and the second adjusting member adjusts the distance by a smaller amount than the first adjusting member.

* * * * *